US009694503B2

(12) United States Patent
Papadopoulos-Papageorgis et al.

(10) Patent No.: US 9,694,503 B2
(45) Date of Patent: Jul. 4, 2017

(54) SHAVER WITH INTERCHANGEABLE CARTRIDGE, CARTRIDGE AND HEAD AND HANDLE ASSEMBLY FOR SUCH SHAVER

(71) Applicant: BIC-VIOLEX SA, Anixi, Attiki (GR)

(72) Inventors: Phaedon Papadopoulos-Papageorgis, Agios Stefanos (GR); Panagiotis Zafiropoulos, Wallingford, CT (US); Dimitrios Efthimiadis, Nea Kypseli (GR)

(73) Assignee: BIC VIOLEX S.A., Anixi (GR)

( * ) Notice: Subject to any disclaimer, the term of this patent is extended or adjusted under 35 U.S.C. 154(b) by 3 days.

(21) Appl. No.: 14/648,356

(22) PCT Filed: Dec. 21, 2012

(86) PCT No.: PCT/EP2012/076798
§ 371 (c)(1),
(2) Date: May 29, 2015

(87) PCT Pub. No.: WO2014/094905
PCT Pub. Date: Jun. 26, 2014

(65) Prior Publication Data

US 2015/0314466 A1 Nov. 5, 2015

(51) Int. Cl.
*B26B 21/52* (2006.01)
*B26B 21/14* (2006.01)
(Continued)

(52) U.S. Cl.
CPC ..... *B26B 21/521* (2013.01); *B26B 21/14* (2013.01); *B26B 21/222* (2013.01); *B26B 21/225* (2013.01); *B26B 21/4012* (2013.01)

(58) Field of Classification Search
CPC ..... B26B 21/14; B26B 21/521; B26B 21/222; B26B 21/225; B26B 21/227; B26B 21/4012
See application file for complete search history.

(56) References Cited

U.S. PATENT DOCUMENTS 3,388,468 A * 6/1968 Hamill ..... B26B 21/40 30/540
3,938,247 A * 2/1976 Carbonell ..... B26B 21/225 30/47
(Continued)

FOREIGN PATENT DOCUMENTS

DE 20 2013 002 343 U9 * 7/2013
FR 2 805v197 A1 8/2001
(Continued)

OTHER PUBLICATIONS

International Report of PCT/EP2012/076798; Aug. 12, 2013.

*Primary Examiner* — Hwei C Payer
(74) *Attorney, Agent, or Firm* — Polsinelli PC

(57) ABSTRACT

A shaver is provided, the shaver includes a handle with an elongated handgrip portion and a mounting portion, a shaver head, the shaver head being attached to the mounting portion, the shaver head having a bottom wall. A removable cartridge is attached to the shaver head through an attaching element provided on the shaver head. An ejection spring provides an ejection force which urges the cartridge away from the shaver head when the cartridge is removed from the shaver head.

13 Claims, 8 Drawing Sheets

(51) Int. Cl.
*B26B 21/22* (2006.01)
*B26B 21/40* (2006.01)

(56) References Cited

U.S. PATENT DOCUMENTS 4,213,240 A * 7/1980 Ferraro ..... B26B 21/521 30/47
4,347,663 A * 9/1982 Ullmo ..... B26B 21/225 30/47
4,574,476 A 3/1986 Ortiz
4,683,096 A * 7/1987 Ferraro ..... B26B 21/443 264/249
5,029,391 A * 7/1991 Althaus ..... B26B 21/521 30/533
5,038,472 A * 8/1991 Iderosa ..... B26B 21/521 30/51
5,070,614 A * 12/1991 Hardin ..... B26B 21/521 30/527
5,715,606 A 2/1998 de Wolf et al.
6,161,288 A * 12/2000 Andrews ..... B26B 21/00 30/50
7,966,731 B2 * 6/2011 Walker ..... B26B 21/225 30/34.1
8,438,735 B2 * 5/2013 De Klerk ..... B26B 21/446 30/41
8,484,852 B2 * 7/2013 King ..... A45D 27/225 30/34.2
2006/0064875 A1 3/2006 Follo et al.
2008/0155831 A1 * 7/2008 Royle ..... B26B 21/222 30/34.1
2011/0088269 A1 * 4/2011 Walker, Jr. ..... B26B 21/225 30/527
2011/0138637 A1 * 6/2011 Bucco ..... B26B 21/521 30/527
2011/0239475 A1 * 10/2011 Efthimiadis ..... B26B 21/521 30/526
2013/0061481 A1 * 3/2013 Cooney ..... B26B 21/521 30/526
2015/0190935 A1 * 7/2015 Griffin ..... B26B 21/225 132/200
2015/0290819 A1 * 10/2015 Giannopoulos ..... B26B 21/222 30/532
2015/0306777 A1 * 10/2015 Georgakis ..... B26B 21/222 30/57
2015/0314465 A1 * 11/2015 Giannopoulos ..... B26B 21/222 30/532
2015/0314466 A1 * 11/2015 Papadopoulos-Papageorgis ..... B26B 21/222 30/532
2015/0321366 A1 * 11/2015 Papadopoulos-Papageorgis ..... B26B 21/222 30/532

FOREIGN PATENT DOCUMENTS

GB 2 411 141 A 8/2005
WO WO 99/06190 A1 2/1999

* cited by examiner

FIG. 4a
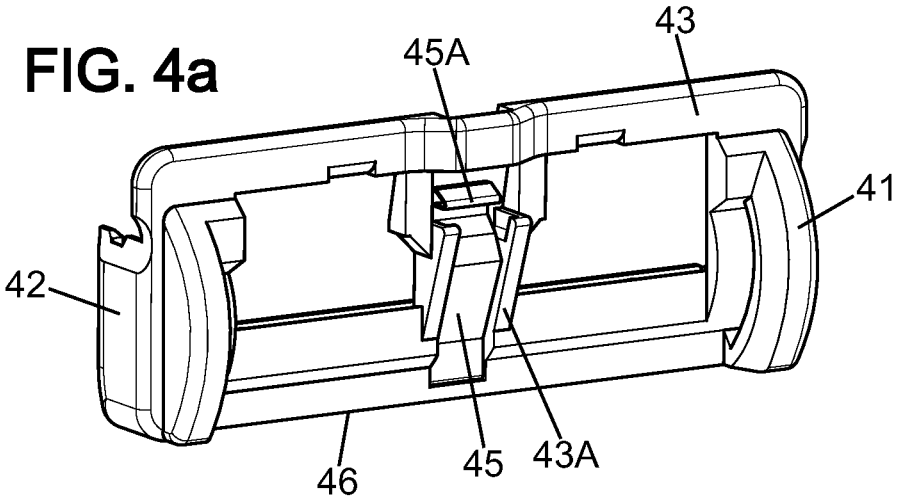
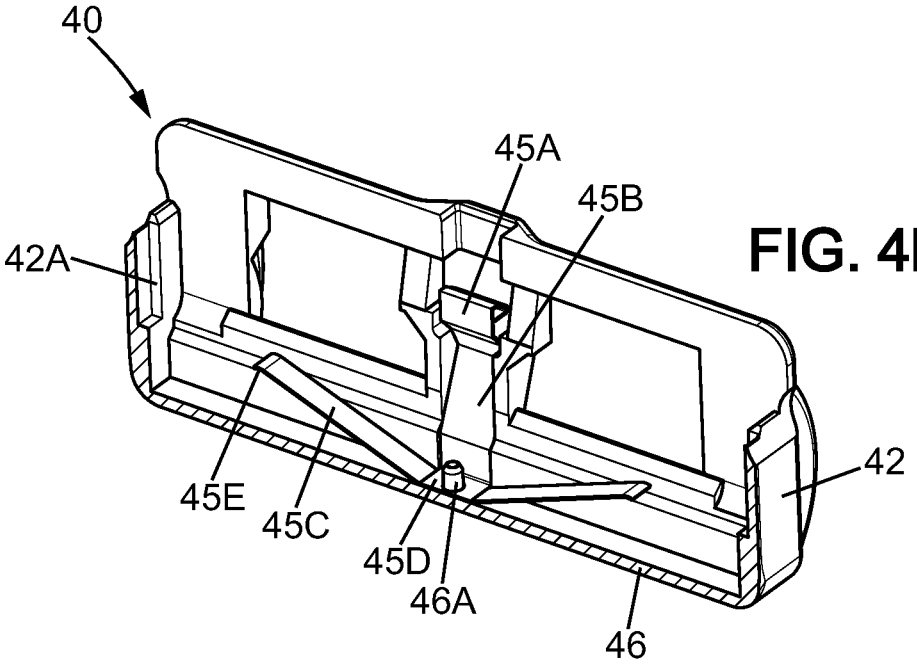
FIG. 4b

SHAVER WITH INTERCHANGEABLE CARTRIDGE, CARTRIDGE AND HEAD AND HANDLE ASSEMBLY FOR SUCH SHAVER

This application is a national stage application of International Application No. PCT/EP2012/076798, filed on Dec. 21, 2012, the entire contents of which are incorporated herein by reference.

FIELD OF INVENTION

The embodiments of the present invention relate to a shaver with interchangeable cartridges, and to cartridges and head and handle assembly for such a shaver.

More particularly, the embodiments of the present invention relate to a shaver that includes:

a handle with an elongated body terminating in a mounting portion for retaining a shaver head, a shaver head adapted to accommodate an interchangeable shaving cartridge, a lock-and-release mechanism to enable the interchangeable shaving cartridge to be loaded and ejected from the shaver head, and an interchangeable cartridge containing one or more blades.

Such a shaver enables the user to replace the cartridge once the blade or blades become worn, while the handle and the shaver head can be kept and reused.

BACKGROUND OF THE INVENTION

The removal from the shaver head of the interchangeable blade cartridges, such as those disclosed in e.g. EP2195145, usually requires the user to press or pull the cartridge to actually displace the cartridge. This means that to replace the cartridge, the user needs to encounter the cartridge by his/her fingers. Therefore the risk of the injury of the user is increased.

SUMMARY OF THE INVENTION

To this aim, a shaver is provided, the shaver comprises a handle with an elongated handgrip portion and a mounting portion, a shaver head, the shaver head being attached to the mounting portion, the shaver head having a bottom wall, a removable cartridge, the cartridge that includes at least one blade, the cartridge being adapted to be attached to the shaver head and removed from the shaver head, an attaching element, adapted to attach the cartridge to the shaver head, and a spring provided on the shaver head, wherein the spring provides an ejection force which urges the cartridge away from the shaver head when the cartridge is removed from the shaver head.

With these features, when the cartridge is to be removed from the shaver head, it is more easily ejected from the shaver head. The user does not have to push or pull the cartridge and the risk of injury of the user is lowered. Moreover, as only the cartridge is replaced when the blades become worn, instead of replacing the whole shaver head, the costs of such shaver are kept lower. As a matter of fact, only the blades are changed every time the cartridge is replaced. Thus, the extra features of the head, like e.g. the lubricating strip or rubber guard bar, may be kept and reused. Further, as only the cartridge is replaced, the shaver is both easier to manufacture and more environment friendly, as the amount of material to be replaced (and disposed of) is reduced.

In some embodiments, one may also use one or more of the following features:

the shaver head may be attached pivotally to the shaver head, the shaver head further comprises a bottom wall positioned in front of the at least one blade in the direction of shaving, and the ejection spring is attached to the bottom wall, the cartridge is ejected in a direction parallel to the direction of shaving, the shaver head further comprises a bottom wall positioned in front of the at least one blade in the direction of shaving, lateral walls, and a spring, and the spring comprises a holding portion, positioned adjacent the bottom wall of the shaver head, the holding portion being adapted to attach the spring to the shaver head, and a pair of symmetrically positioned ejection springs, the ejection springs being provided as elastic wings, the elastic wings extending from the holding portion in a direction towards the lateral walls, each of the wings terminates in a bent portion, the spring is made of metal, the attaching element and the ejection spring belong to the same elastic metal part, the metal part further that includes an elastic body connecting the attaching element to the at least one ejection spring, the attaching element and the spring are formed as a one-piece body, and the attaching element and the spring are connected via an elastic body, the elastic body extending from the holding portion of the spring in a direction away from the bottom wall of the shaver head, the shaver head further comprises a bottom wall, the bottom wall being positioned in front of the at least one blade in the direction of shaving, and a guard member, the guard member being positioned adjacent the bottom wall, the handle further comprises a slidable button, the button that includes a pusher, the pusher being adapted to encounter the elastic body of the spring and thus release the cartridge, the cartridge comprises a holder, and wherein the attaching element and the holder cooperate to attach the cartridge to the shaver head, the shaver head further comprises lateral walls, the lateral walls may comprise guide tracks, the cartridge may further comprise lateral walls, the lateral walls that includes guide tracks, and the guide tracks of the cartridge may cooperate with guide tracks of the shaver head.

In another aspect of the present invention, a cartridge is provided, the cartridge comprises a holder, and the holder has an overall shape of a hook.

One may also use one or more of the following features:

the cartridge comprises at least one blade, the at least one blade is mounted movably, the cartridge further comprises a top wall and a shaving aid, the shaving aid positioned in the top wall.

In another aspect of the present invention, a head and handle assembly for a shaver as described above may be provided, the assembly that includes: a handle with an elongated handgrip portion and a mounting portion, a shaver head, the shaver head being adapted to receive a cartridge, the shaver head being attached to the mounting portion, an ejection spring provided on the shaver head, and an attaching element adapted to attach a cartridge to the shaver head, wherein the ejection spring provides an ejection force which urges the cartridge away from the shaver head when the cartridge is removed from the shaver head.

In some embodiments of the assembly, one may also use one or more of the following features:

the shaver head may be attached pivotally to the mounting portion, the shaver head further comprises a bottom wall, and the spring is attached to the bottom wall, the cartridge is ejected in a direction parallel to the direction of shaving, the shaver head further comprises a bottom wall and lateral walls, and the spring comprises a holding portion, positioned adjacent the bottom wall of the shaver head, the holding portion being adapted to attach the spring to the shaver head, and a pair of symmetrically positioned elastic wings, the elastic wings extending from the holding portion in a direction towards the lateral walls, each of the wings terminates in a bent portion, the spring is made of metal, the attaching element further comprises an elastic body, and the attaching element is provided as a part of the shaver head, the attaching element is made of plastic, the attaching element and the spring are formed as a one-piece body, and the attaching element and the spring are connected via an elastic body, the attaching element and the spring are formed as a one-piece body, and the attaching element and the spring are connected via an elastic body, the elastic body extending from the holding portion of the spring in a direction away from the bottom wall of the shaver head, the shaver head further comprises a bottom wall and a guard member, the guard member being positioned adjacent the bottom wall.

BRIEF DESCRIPTION OF THE DRAWINGS

Other characteristics and advantages of the invention will readily appear from the following description of one of its embodiments, provided as a non-limitative examples, and of the accompanying drawings.

On the drawings:

FIG. 4*a* shows a shaver head without the cartridge as seen from the back FIG. 4*b* shows a detail of the shaver head

On the different Figures, the same reference signs designate like or similar elements.

DETAILED DESCRIPTION

Figure 1A:
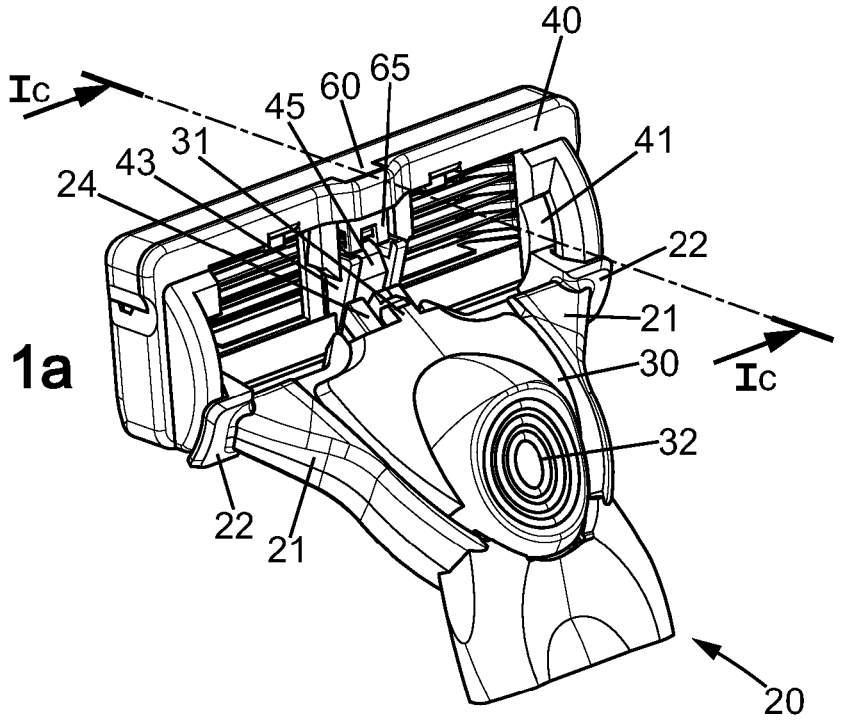
FIG. 1*a* shows an overall view of the shaver from the back side
Figure 1B:
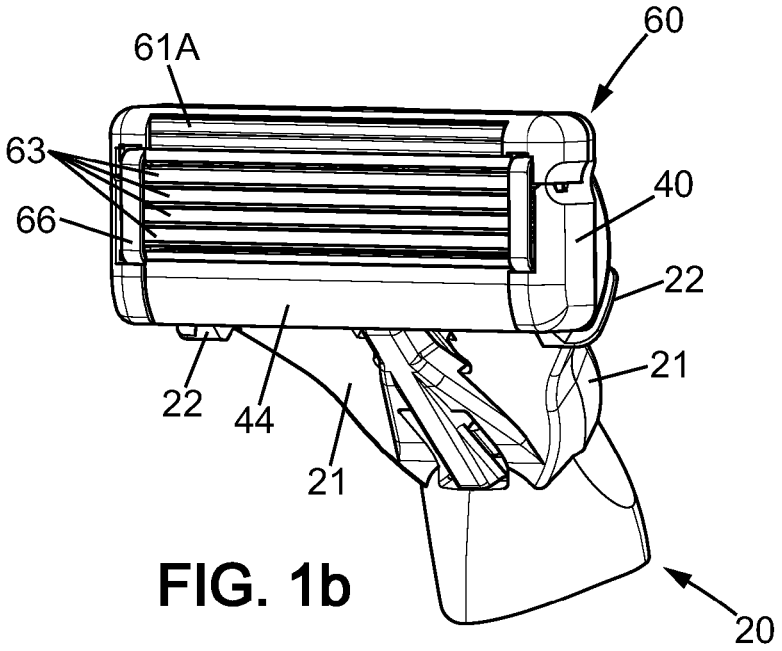
FIG. 1*b* shows an overall view of the shaver from the front side
Figure 1C:
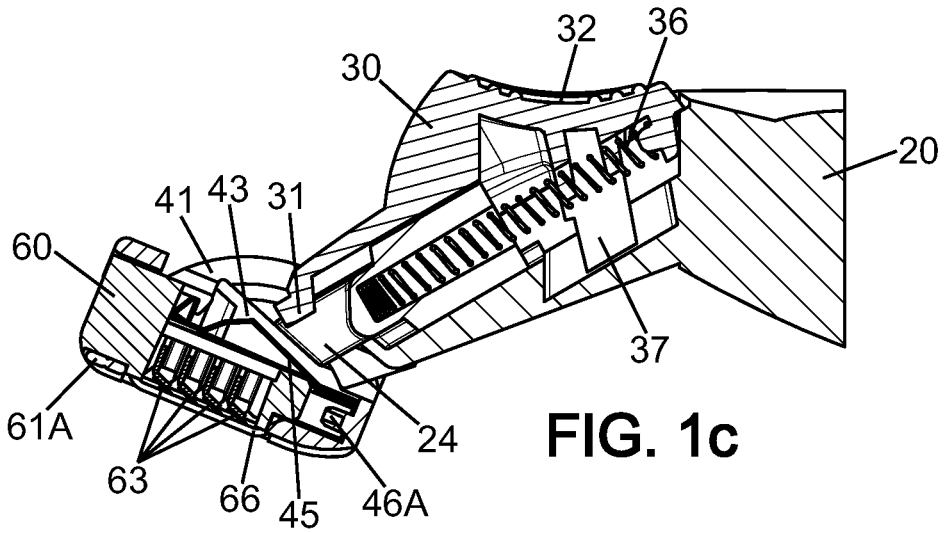
FIG. 1*c* shows a cross-section along a line Ic of the shaver

FIGS. 1*a* to 1*c* show an example of a shaver according to the present invention. The shaver comprises a handle 20, a shaver head 40 and a cartridge 60, which accommodates one or more blades 63. On the example shown on the Figures, there are four blades. However, the cartridge may also use more or less of blades.

Figure 5A:
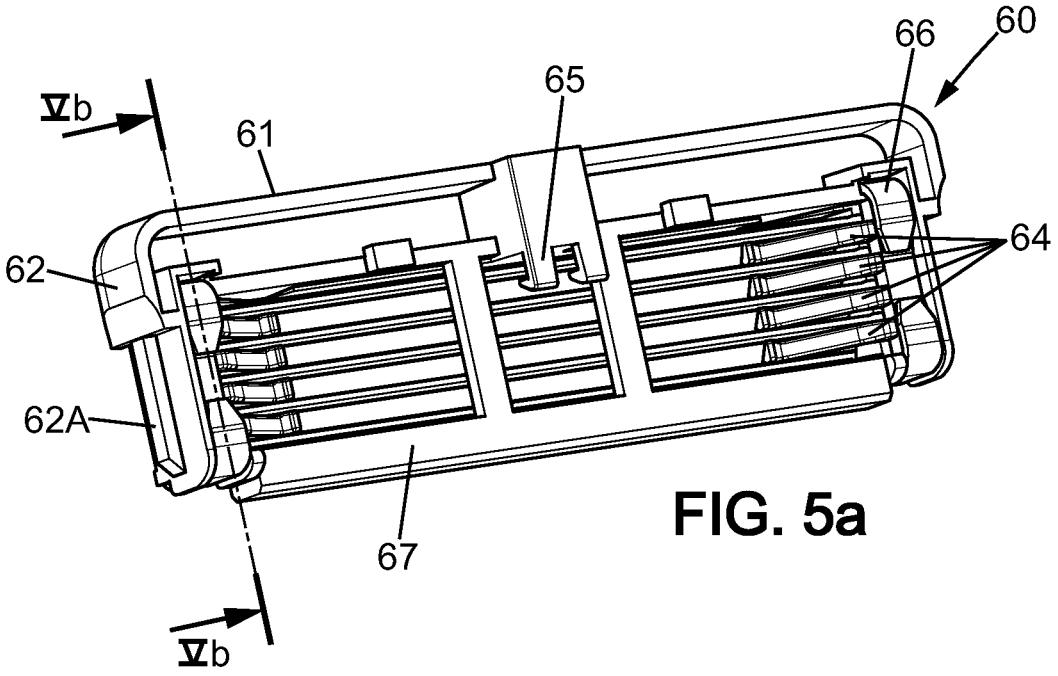
FIG. 5*a* is a back view of the cartridge
Figure 5B:
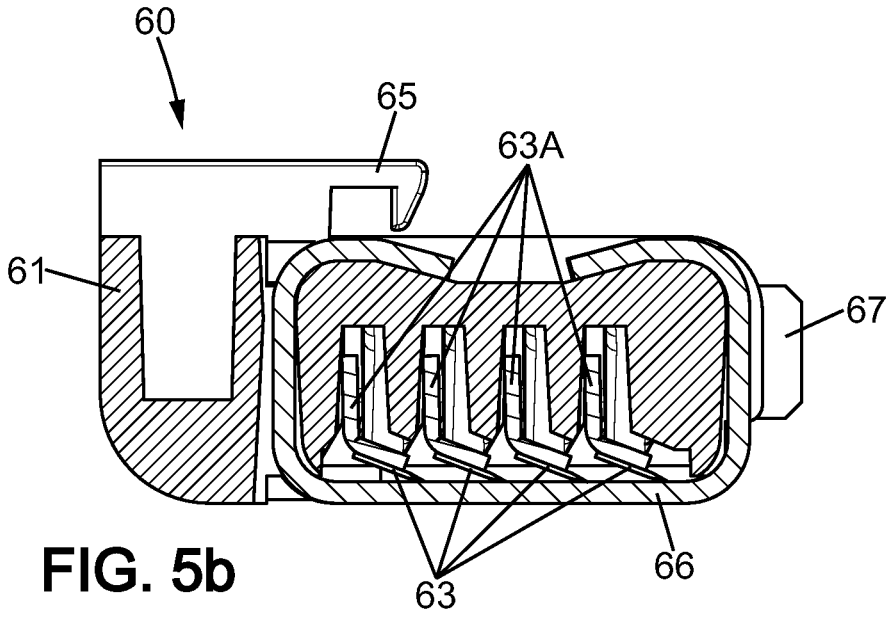
FIG. 5*b* shows a cross-section of the cartridge along a line Vb.

The cartridge (FIGS. 3, 5*a* and 5*b*) 60 is formed as a frame with a top wall 61, two lateral walls 62, bottom wall 67 and a back structure (shown in detail on FIG. 5*a*). The top wall 61 and the bottom wall 67 are elongated and connected by the lateral walls 62. The frame of the cartridge 60 may be molded out of plastic; preferably, the frame is one-piece. The blades 63 extend between the lateral walls 62, parallel to the top wall 61 and the bottom wall 67. The blades 63 may be made from bent sheet metal, or, preferably, they may be straight and supported with blade supports 63A. The blades 63 and/or the blade supports 63A are then accommodated in seats 63B provided in the lateral walls 62. Moreover, the blades may for instance be placed movably. The lateral walls 62 may be provided with elastic fingers 64, extending towards the insides of the cartridge frame, in a direction parallel to the blades 63, and supporting movably the blades 63. The blades 63 may be held in the cartridge by a pair of bent metal strips 66, which encircle the ends of the blades 63 and thus hold them in place. The number of blades may be for example four. In the top wall 61, lying generally in a plane defined by the blade edges, a shaving aid 61A may be provided. In other embodiments, the blades may be fixed.

Figure 2A:
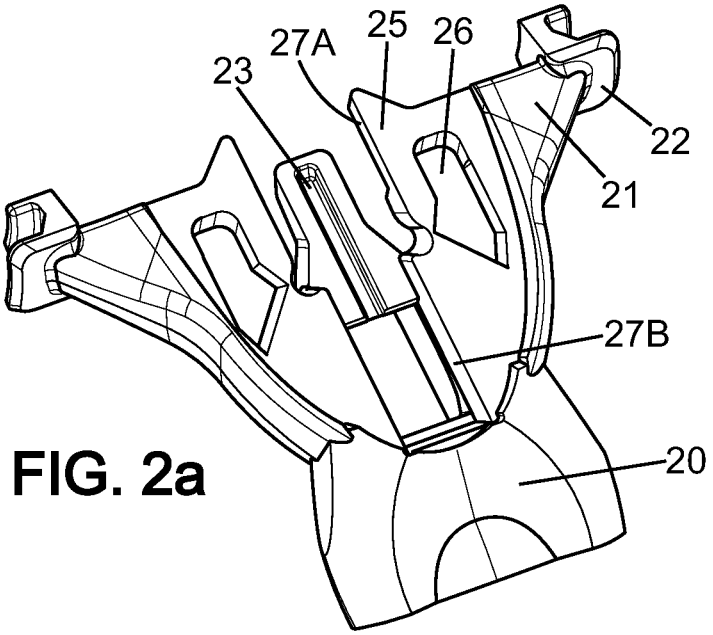
FIG. 2*a* shows a front portion of the handle
Figure 2B:
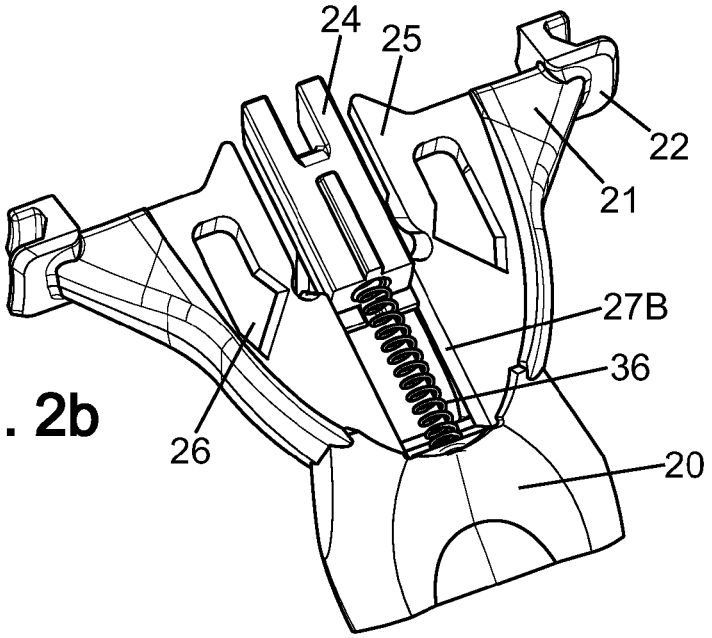
FIG. 2*b* shows a front portion of the handle with a cam follower and a spring

The handle 20 has an elongated handgrip portion (not shown) which may be provided with features that enhance grip of the user and help prevent slipping, such as ribs, pegs, elastomeric parts and the like. The handle 20 is preferably molded out of a plastic material. The handle 20 is terminated in two yokes 21 extending from the handle, as shown on FIG. 2. The yokes 21 end in a mounting portion, which may be provided in a form of shell bearings 22. The shell bearings 22 then cooperate with complementary depressions 41 provided on the shaver head 40. The shell bearings 22 and the complementary depressions 41 together enable the shaver head 40 to pivot about an axis parallel to the length of the blades 63. Alternatively, the shell bearings 22 may be replaced by hinges, pins or other pivoting means; the shaver head 40 may also be attached to the handle 20 without any pivoting means. Here, only the pivoting head will be described.

The yokes 21 further define a gap 23, positioned between the yokes 21. The gap 23 accommodates a cam follower 24. The cam follower 24 has a bifurcated end; the two branches cooperate with a pair of rests 43A provided on back wall 43 of the shaver head 40, therefore enabling the shaver head 40 to be returned to the neutral position. The cam follower 24 is operated by a coil spring 36, which is preferably made of metal.

Figure 3:
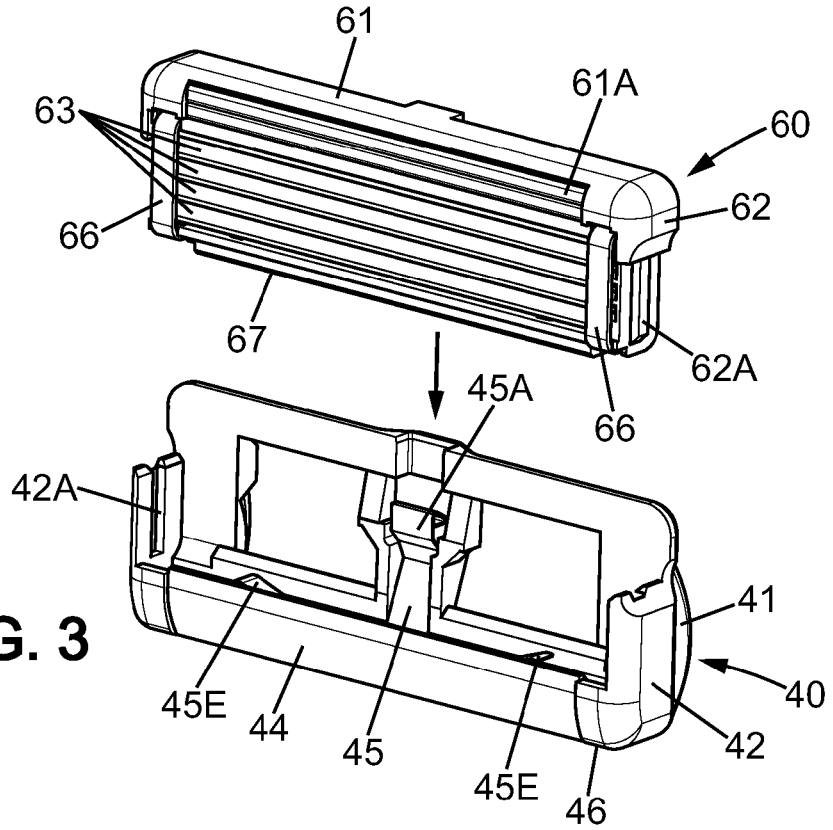
FIG. 3 shows a front view of the cartridge and the shaver head upon the insertion of the cartridge

An example of a shaver head 40 is shown on FIG. 3 FIGS. 4*a* and 4*b*. The shaver head comprises a front wall 44, a back wall 43, a bottom wall 46 and lateral walls 42. The front wall 44 may include a skin engaging element or a guard (not shown), preferably made in an elastomeric material. The back wall 43 comprises depressions 41, which accommodate shell bearings 22, positioned at the end of the handle 20. On the back wall 43, there is also a pair of rests 43A, cooperating with the cam follower 24.

The shaver head 40 forms a seating where the cartridge 60 can be accommodated (detail of such seating is shown on FIG. 4*b*). The cartridge 60 is preferably inserted from the side opposing the bottom wall 46, as shown on FIG. 3, generally in a direction of shaving. The lateral walls 42 include guide tracks 42A, formed as grooves on the insides of the lateral walls 42. Once the cartridge 60 is inserted into the shaver head, the guide tracks 42A are encountered by guide tracks 62A provided as protrusions on the lateral walls 62 of the cartridge 60 and the cartridge 60 is guided to its seating. The risk of wrong insertion of the cartridge 60 is thus lowered.

Once the cartridge 60 is inserted into the shaver head 40, it encounters an attaching element 45A and at least one ejection spring 45C. The attaching element 45A is adapted to attach the cartridge 60 to the shaver head 40. Preferably, the attaching element 45A attaches the cartridge 60 to the shaver head 40 by snap-fitting.

Figure 6A:
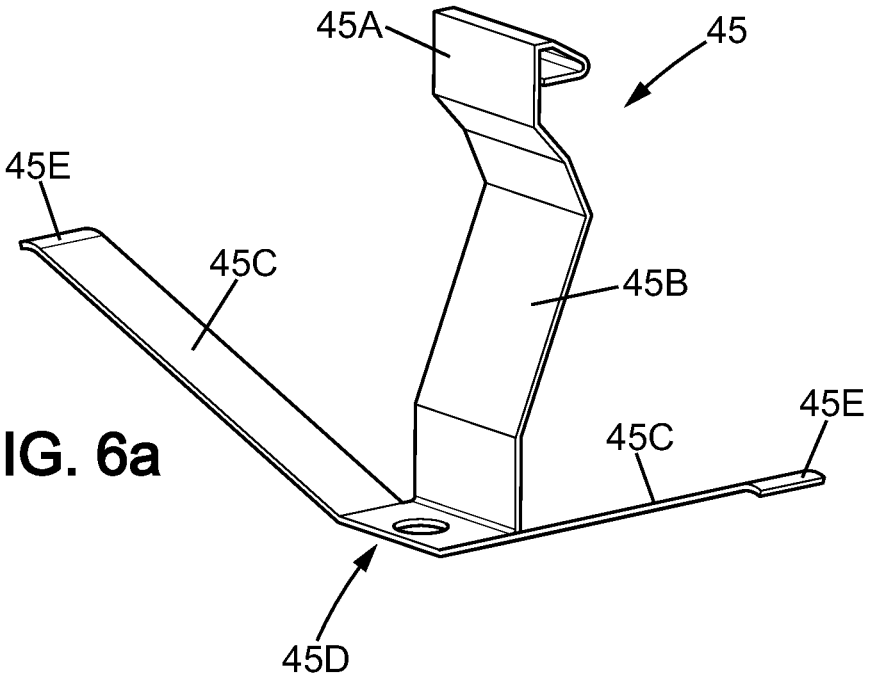
FIG. 6*a* shows an overall view of the spring
Figure 6B:
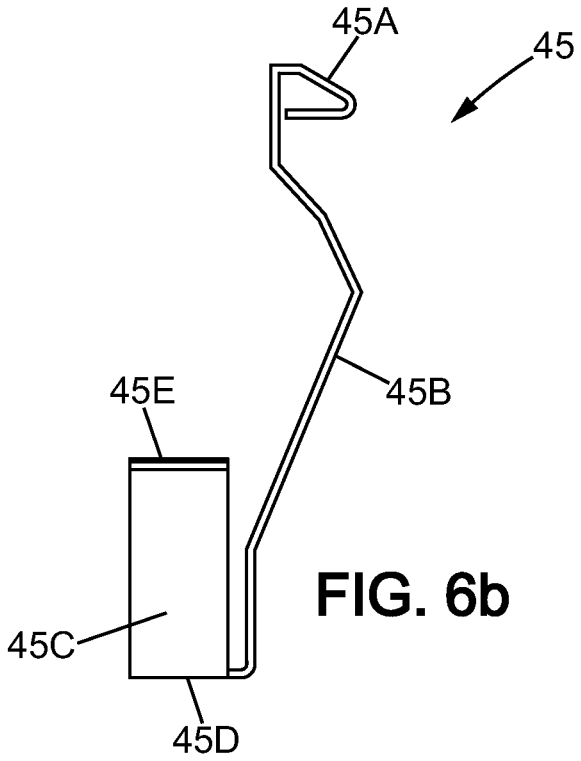
FIG. 6*b* shows a lateral view of the spring
Figure 6C:
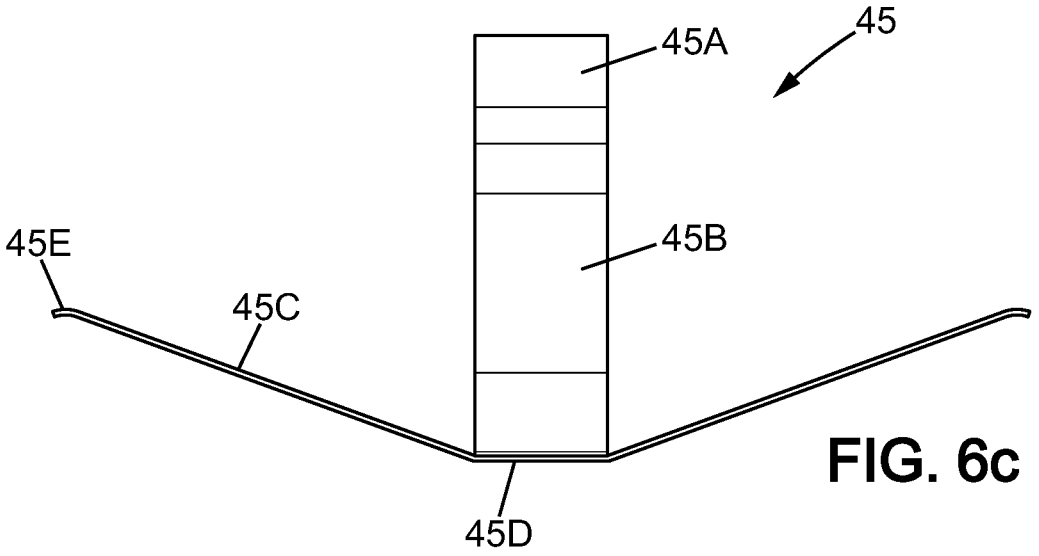
FIG. 6*c* shows a front view of the spring

In an example shown on the Figures, the attaching element 45A is provided as a part of a spring 45. The spring 45 is positioned in the bottom wall 46 of the shaver head 40. The spring is shown on FIGS. 6*a* to 6*c*. The attaching element 45A takes a form of a snap-fitting portion 45A extending from an elastic body 45B. The spring 45 may further comprise an ejection spring 45C. The ejection spring 45C is preferably provided as a pair of symmetrically positioned elastic wings 45C. The spring 45 also comprises a holding portion 45D, which is adapted to hold the spring 45 in its position. On FIG. 6*b*, the elastic body 45B is shown to extend from the holding portion 45D in a direction away from the bottom wall 46. The elastic body 45B is bent towards the back wall 43 of the shaver head 40 and then back to form a substantially C-shaped strip. The elastic body 45B, when assembled in the shaver head 40, is preferably positioned so that the C-shaped part protrudes between the pair of the rest portions 43A of the shaver head 40. On the top of the elastic body 45B, there is a snap-fitting portion 45A, which forms a small loop that is turned towards the back wall 43 of the shaver head 40. The wings 45C extend from the holding portion 45D generally in a direction towards the lateral walls 42, preferably in an angle that is more than 15 degrees with respect to the bottom wall 46. A small portions of the ends 45E of the wings 45C are bent towards the bottom wall 46, thus simplifying insertion of the bottom wall 67 of the cartridge 60 and avoiding its damage.

In one possible embodiment, the attaching element 45A, together with the elastic body 45B, are provided as a part of the shaver head 40. The attaching element 45A and the elastic body 45B may be made of metal, plastic, or any other suitable material with elastic properties. The attaching element 45A and the elastic body 45B may be provided molded integrally with the shaver head 40. The ejection spring 45C may then be provided as a separate component. In such example, the spring 45 comprises the holding portion 45D, and the wings 45C. The structure of the holding portion 45D, the wings 45C, and the position of the holding portion 45D and the wings 45C with regards to the shaver head 40 is similar to the example shown in the Figures.

Below, only the embodiment with the spring 45 being formed integrally with the attaching element 45A and the ejection spring 45C will be described.

The back structure of the cartridge 60 is provided with a holder 65, which can be encountered by the snap-fitting portion 45A of the spring 45. The holder 65 is preferably formed as a pair of small toward-the-blades oriented hooks, as seen on FIGS. 5*b* and 5*c*; however, other configurations such as only a single hook are also possible.

Once the cartridge 60 is inserted, the holder 65 is encountered by the snap-fitting portion 45A of the spring 45, the snap-fitting portion 45A of the spring 45 is held by the holder 65, and thus the cartridge 60 is retained in its seating in the shaver head 40.

The spring 45 is attached to the bottom wall 46 of the shaver head 40 by its holding portion 45D by a holding portion 46A of the shaver head. The holding portion 46A may be for example a screw, a bolt, or the like. The spring 45 is thus permanently attached to the shaver head 40. The spring 45 is preferably made of metal, therefore being resilient and not easily destroyed, but may be made in any other suitable material, such as plastic or material with elastic properties.

Once the cartridge 60 is inserted into the shaver head 40, the cartridge 60 preferably does not perform any movements with respect to the shaver head 40. The shaver head 40 is attached pivotally to the handle 20; preferably, the pivoting means 22, 41 are provided on the shaver head 40 and on the handle 20, but not on the cartridge 60.

The above described mechanism, which uses the spring 45 provided on the shaver head 40 and the holder 65 provided on the cartridge 60, brings about several advantages. The only replaced component is the cartridge 60, which in itself does not hold any additional features (such as pivoting means and the like). Therefore the price of the cartridge 60 may be lowered and the manufacturing process thereof may be simplified; as the shaver head 40 and the handle 20 are not replaced, they may be manufactured as being more robust while keeping the price reasonable. Especially, the means provided to secure the pivoting attachment of the shaver head 40 to the handle 20, may be made more reliable. Moreover, the snap-fitting mechanism is both easy to manufacture and easy to operate. Since the shaver head 40 and the cartridge 60 are provided with guide tracks 42A and 62A, respectively, the insertion of the cartridge 60 into the shaver head 40 is simplified and the risk of wrong insertion of the cartridge 60 is lowered. The simplified design of the cartridge 60 may be further beneficial with regards to sustainability, as the cartridge 60 may be washed with reduced amount of water.

When the cartridge 60 is attached to the shaver head 40, the wings 45C of the spring are compressed by the cartridge 60. Therefore, the ends 45E of the wings 45C that are bent are preferably so short as to avoid damage of the bottom wall 46 of the shaver head 40.

Figure 7A:
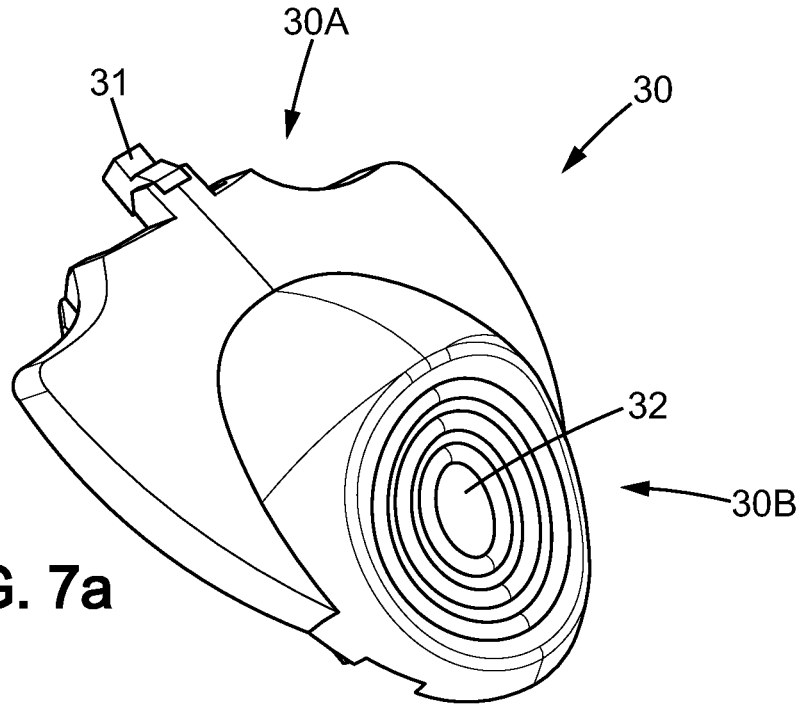
FIG. 7*a* shows a top side of the button
Figure 7B:
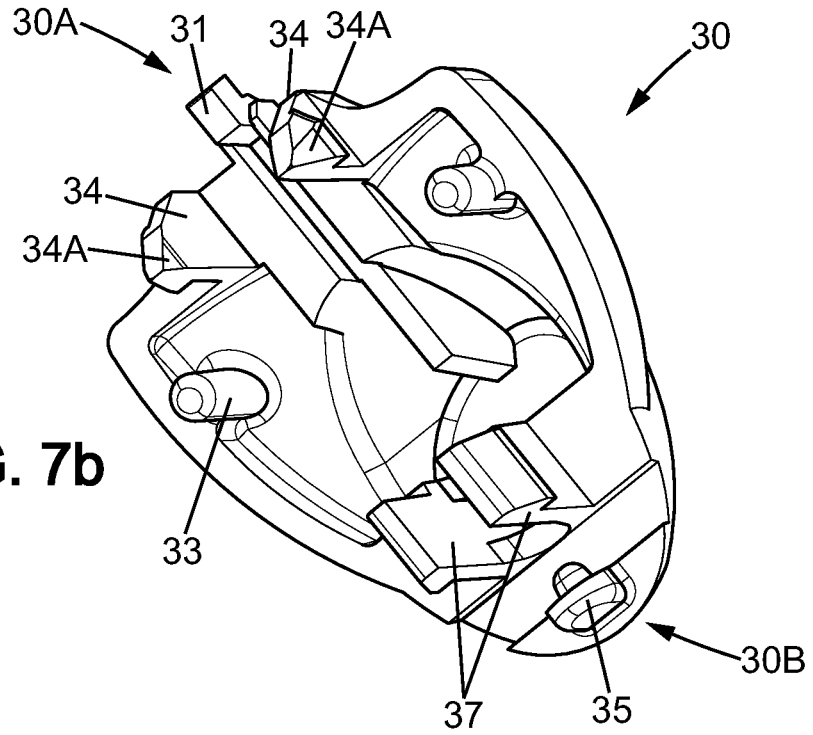
FIG. 7*b* shows a bottom side of the button
Figure 7C:
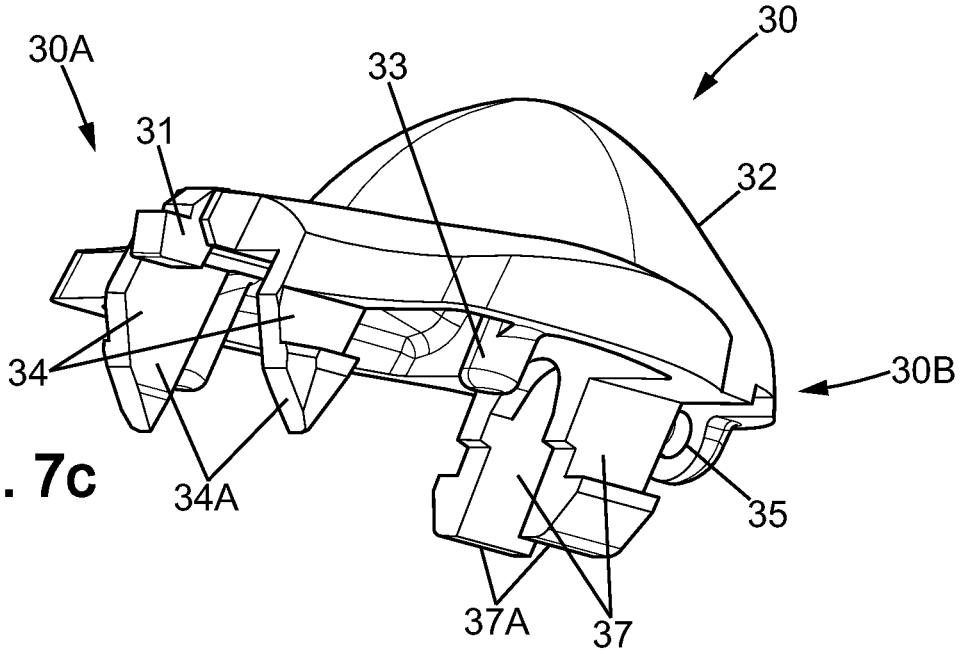
FIG. 7*c* shows an overall view of the button

The top part of the handle 20 adjacent the shaver head 40 is also provided with a button 30 (see FIGS. 7*a* to 7*c*). The button 30 has a front end 30A and a rear end 30B. The button 30 is slidable in a direction generally parallel to the longitudinal direction of the handle 20. To ensure sliding of the button 30, two pair of guides 34 and 37 are provided on the part of the button 30 that is adjacent to the handle 20. The guides 34, 37 encounter the guide trails 27A, 27B provided on the front portion of the handle 20; preferably, the guides 34, 37 are provided with a bent lower portions 34A, 37A so as to ensure that they do not disengage from the respective guide trails 27A, 27B. In this way, the guides 34, 37, when in cooperation with guide trails 27A, 27B, provide the button 30 with sliding in a direction generally parallel to the length of the handle 20, prevents the button 30 from moving elsewhere, and also prevents the button 30 from disengaging from the handle 20.

The button 30 comprises a finger receiving region 32, provided on the top part of the button 30. As can be seen on FIG. 7*a*, the finger receiving region 32 may be equipped with features that help to prevent slipping of user's fingers. Once the user encounters the button 30 with his/her finger, s/he may push the button 30 in a direction towards the shaver head 40. To return the button 30 to its initial position, the button 30 is provided with a coil rest 35, which is positioned at the rear end 30B of the button 30, adjacent the handle 20. The coil rest 35 cooperates with the coil spring 36. When the button 30 is pressed by the user, the coil spring 36 is compressed, and once the button 30 is released, the coil spring 36 returns the button 30 to its original position.

The button 30 further comprises a pusher 31. The pusher 31 is located in the front end 30A of the button, adjacent the shaver head 40. The pusher 31 takes a form of a projection which extends from the button 30 in a direction of the shaver head 40. Preferably, the projection of the pusher 31 is located between the two branches of the bifurcated end of the cam follower 24 so that it can easily reach the elastic body 45B of the spring 45, which is located between the rests 43A for the cam follower 24. In this way, the cam follower 24 and the pusher 31 do not interfere.

Once the user wishes to replace the cartridge 60, s/he pushes the button 30 and the cartridge 60 is disengaged. More specifically, the pusher 31 presses the C-shaped part of the elastic body 45B of the spring 45. The elastic body 45B of the spring 45 is then deformed, thus releasing the snap-fitting portion 45A of the spring 45 from the holder 65, and the spring 45 no longer holds the cartridge 60 in place. Moreover, the wings 45C of the spring 45, which are compressed by the cartridge 60, tend to return to their initial position. The wings 45C of the spring 45 urge the cartridge 60 away from its seating, and the cartridge 60 is ejected. In this way, the user does not have to touch the cartridge 60 by his/her fingers and the risk of cutting the user's fingers with the blades 63 is then reduced.

Moreover, as can be seen on FIGS. 7*b* and 7*c*, the button 30 comprises a pair of safeguards 33. The safeguards 33 generally take a form of pins protruding downwards from the button 30. The handle is adapted to receive these safeguards 33 in grooves 26, carved in the handle 20. The safeguards 33 can slide back and forth in the grooves 26, and given the shape of the grooves, they prevent the yokes 21 from being accidentally moved closer together. When the yokes 21 cannot be moved closer together, the risk of the yokes accidentally releasing the shaver head as a whole is reduced, thus reducing risk of injury of the user.

The invention claimed is:

1. A shaver comprising:

a handle with an elongated handgrip portion and a mounting portion, a shaver head, the shaver head being attached to the mounting portion, a removable cartridge including at least one blade, the cartridge being adapted to be attached to the shaver head and removed from the shaver head, and an attaching element, adapted to attach the cartridge to the shaver head by snap-fitting wherein the shaver head further comprises a bottom wall positioned in front of the at least one blade in a direction of shaving, lateral walls, and a spring which provides an ejection force which urges the cartridge away from the shaver head when the cartridge is removed from the shaver head, wherein the spring comprises:

a holding portion, positioned adjacent to the bottom wall of the shaver head, the holding portion being adapted to attach the spring to the shaver head, and a pair of symmetrically positioned ejection springs, the ejection springs being provided as elastic wings, the elastic wings extending from the holding portion in a direction towards the lateral walls.

2. The shaver according to claim 1, wherein each of the wings terminates in a bent portion.

3. A shaver comprising:

a handle with an elongated handgrip portion and a mounting portion, a shaver head, the shaver head being attached to the mounting portion, a removable cartridge including at least one blade, the cartridge being adapted to be attached to the shaver head and removed from the shaver head, an attaching element, adapted to attach the cartridge to the shaver head by snap-fitting, and at least one ejection spring provided on the shaver head, wherein the at least one ejection spring provides an ejection force which urges the cartridge away from the shaver head when the cartridge is removed from the shaver head, wherein the shaver head further comprises lateral walls, wherein the lateral walls of the shaver head comprise guide tracks, wherein the cartridge further comprises lateral walls, the lateral walls of the cartridge comprising guide tracks, and wherein the guide tracks of the cartridge cooperate with the guide tracks of the shaver head.

4. A head and handle assembly for a shaver, the head and handle assembly comprising:

a handle with an elongated handgrip portion and a mounting portion, a shaver head, the shaver head being attached to the mounting portion, the shaver head being adapted to receive a cartridge, an attaching element, adapted to attach the cartridge to the shaver head by snap-fitting, and at least one ejection spring provided on the shaver head, wherein the at least one ejection spring provides an ejection force which urges the cartridge away from the shaver head when the cartridge is removed from the shaver head, wherein the attaching element and the at least one ejection spring belong to the same elastic part, the elastic part further comprising an elastic body connecting the attaching element to the at least one ejection spring.

5. A shaver comprising:

a handle with an elongated handgrip portion and a mounting portion, a shaver head, the shaver head being attached to the mounting portion, a removable cartridge including at least one blade, the cartridge being adapted to be attached to the shaver head and removed from the shaver head, an attaching element, adapted to attach the cartridge to the shaver head by snap-fitting, and at least one ejection spring provided on the shaver head, wherein the at least one ejection spring provides an ejection force which urges the cartridge away from the shaver head when the cartridge is removed from the shaver head; and wherein the attaching element and the at least one ejection spring belong to the same elastic part, the elastic part further including an elastic body connecting the attaching element to the at least one ejection spring.

6. The shaver according to claim 5, wherein the shaver head is attached pivotally to the mounting portion.

7. The shaver according to claim 5, wherein the shaver head further comprises a bottom wall positioned in front of the at least one blade in a direction of shaving, and wherein the ejection spring is attached to the bottom wall.

8. The shaver according to claim 5, wherein the cartridge is ejected in a direction parallel to a direction of shaving.

9. The shaver according to claim 5, wherein the ejection spring is made of metal.

10. The shaver according to claim 5, wherein the shaver head further comprises a bottom wall, the bottom wall being positioned in front of the at least one blade in the direction of shaving, and a guard member, the guard member being positioned adjacent the bottom wall.

11. The shaver according to claim 5, wherein the handle further comprises a slidable button, the button comprising a pusher, the pusher being adapted to encounter the elastic body of the elastic part and thus release the cartridge.

12. The shaver according to claim 5, wherein the cartridge comprises a holder, and wherein the attaching element and the holder cooperate to attach the cartridge to the shaver head.

13. A shaver according to claim 5, wherein the at least one ejection spring is made of metal.

* * * * *